US007794248B2

(12) United States Patent
Kobayashi

(10) Patent No.: US 7,794,248 B2
(45) Date of Patent: Sep. 14, 2010

(54) LEVER ENGAGEMENT TYPE CONNECTOR

(75) Inventor: Toru Kobayashi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/553,287

(22) Filed: Sep. 3, 2009

(65) Prior Publication Data

US 2010/0068906 A1 Mar. 18, 2010

(30) Foreign Application Priority Data

Sep. 18, 2008 (JP) ..... 2008-238954

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 5,344,194 A * 9/1994 Hatagishi et al. ..... 285/26
6,213,794 B1 4/2001 Okabe et al.
2007/0173091 A1* 7/2007 Taguchi et al. ..... 439/157
2007/0184692 A1* 8/2007 Ohtaka et al. ..... 439/157

FOREIGN PATENT DOCUMENTS

JP 2000-058191 A 2/2000

* cited by examiner

*Primary Examiner*—Tho D Ta
(74) *Attorney, Agent, or Firm*—Sughrue Mion, PLLC

(57) ABSTRACT

A lever type engagement connector includes a first connector; a second connector to be engaged with the first connector; and a lever including a connection portion at which the lever is jointed to the first connector, and an end portion at which the lever is jointed to the second connector so as to rotate from a first position to a second position, an operation portion which is provided at an opposite side of the end portion respective to the connection portion, and a lock portion which is provided between the operation portion and the first connector when the lever is at the first position and is engaged with the second connector when the lever is at a second position. Preferably, the operation portion defines a touching surface and the lock portion is provided below the touching surface.

5 Claims, 3 Drawing Sheets

LEVER ENGAGEMENT TYPE CONNECTOR

CROSS-REFERENCE TO RELATED APPLICATIONS

This application claims priority from Japanese Patent Application No. 2008-238954 filed on Sep. 18, 2008 and the subject matters of which are incorporated herein by reference.

TECHNICAL FIELD

The present invention relates to a lever engagement type connector in which one connector is engageably connected to another connector by rotating an engagement manipulation lever attached to the one connector.

BRIEF DESCRIPTION OF RELATED ART

FIG. 3 shows a related lever engagement type connector.

This lever engagement type connector is a connector disclosed in JP-A-2000-58191. The lever engagement type connector includes a male connector 1, an engagement manipulation lever 2 rotatably attached to the male connector 1, and a female connector 3 into which the male connector 1 is engaged.

The male connector 1 has a plurality of terminal accommodating chambers 4 in each of which a terminal is to be accommodated. The terminal accommodating chambers 4 extends in a connector engage direction in which the male connector 1 and the female connector 3 are engaged. Further, a pair of latch ribs 6 extending in the connector engaging direction are formed at end portions of both side surfaces 5 of the male connector 1 so as to vertically project from the both side surfaces 5. Between each of the latch ribs 6 and the side surface 5, an elongated hole 7 is provided along the connector engaging direction.

Furthermore, a boss portion 8 is provided at a substantially central portion of each side surface 5 of the male connector 1. The boss portion 8 vertically projects from the side surface 5. The boss portion 8 supports the engagement manipulation lever 2 rotatably.

The engagement manipulation lever 2 has a pair of right and left side walls 9 and a operation portion 10 which interconnects the left and right side walls 9. Each of the left and right side walls 9 has a connecting hole 11 at a position corresponding to the boss portion 8. The connecting hole 11 supports the boss portion 8 of the male connector 1 so as to rotate. This connecting hole 11 functions as a connecting portion for rotatably connecting the engagement manipulation lever 2 to the male connector 1.

The operation portion 10 of the engagement manipulation lever 2 interconnects proximal end sides of the left and right side walls 9. The operation portion is pressed when the connectors are engaged. In contrast, respective distal ends of the left and right side walls 9 on the opposite side to the operation portion 10 are formed as engagement projections 12. As these engagement projections 12 are inserted into the elongated holes 7 of the male connector 1, the engagement projections 12 are prevented from coming off the latch ribs 6, thereby preventing the engagement manipulation lever 2 from coming off the male connector 1.

An engaging portion 21, which is rotatably retained by the female connector 3, is projectingly provided on each of the left and right side walls 9 of the engagement manipulation lever 2 at a position offset from the aforementioned connecting hole 11 toward the distal side end.

In addition, the engagement manipulation lever 2 has a cavity portion 24 adjacent to the press manipulation portion 10. In the cavity portion 24, a lock portion 25 is provided. When the engagement between the male connector 1 and the female connector 3 is completed by the rotative manipulation of the engagement manipulation lever 2, the lock portion 25 is engaged with the female connector 3 to prevent the engagement manipulation lever 2 from retuning.

The female connector 3 has a hood portion 13 whose upper side is open and into which the male connector 1 is engaged. Further, an elongated groove 16 into which the latch rib 6 of the male connector 1 is inserted and a fulcrum retaining portion 23 for rotatably retaining the aforementioned engaging portion 21 are provided on each of the side surfaces of the hood portion 13.

As for such a lever engagement type connector, the engagement manipulation lever 2 is set in advance in a state of being assembled to the male connector 1. In this state, the engagement starting end (the lower end in FIG. 3) of the male connector 1 is inserted into the hood portion 13 which is an engagement starting end of the female connector 3, and the engaging portions 21 of the engagement manipulation lever 2 are kept rotatably retained by the fulcrum retaining portions 23 of the female connector 3.

In this state, if the operation portion 10 at the proximal end of the engagement manipulation lever 2 is pressed toward the female connector 3 side, by means of the lever motion using the fulcrum retaining portions 23 of the female connector 3 as a fulcrum of rotation, using the connecting portions between the boss portions 8 of the male connector 1 and the connecting holes 11 of the engagement manipulation lever 2 as a point of application, and using the operation portion 10 as a point of effort, the male connector 1 connected at the point of application is pressed into the female connector 3, allowing the engagement between the male connector 1 and the female connector 3 to proceed.

Then, upon completion of engagement between the male connector 1 and the female connector 3 by the rotation of the engagement manipulation lever 2, the lock portion 25 disposed adjacent to the operation portion 10 is engaged with an unillustrated lock engaging portion on the female connector 3 side, thereby restricting the return of the engagement manipulation lever 2.

SUMMARY

However, in the case of the related lever engagement type connector, the lock portion 25 is disposed adjacent to the operation portion 10 which is pressed at the time of the rotative manipulation of the engagement manipulation lever 2, and the width W1 of the opening of the cavity portion 24 where the lock portion 25 is disposed is of such a size as to allow an operator's fingertip to enter.

For this reason, there have been cases where the fingertip which presses the operation portion 10 touches the lock portion 25 by mistake, leading to the loss of the operational sound and a manipulation feeling which occur at the time of normal locking operation of the lock portion 25.

In such a case, there has been a problem in that the operator is unable to promptly perceive the completion of the engagement operation of the connectors from the operational sound and the manipulation feeling of the lock portion 25, so that a need arises to confirm the operational state of the lock portion 25, leading to a delay in operation.

In addition, in the case of the engagement manipulation lever 2 in the related lever engagement type connector, since the lock portion 25 is exposed in the vicinity of the corner portion on the proximal end side, there has been a possibility that the lock portion 25 is liable to come into contact with another device during transport, possibly damaging the lock portion 25 due to the collision with the other device.

Accordingly, an object of the invention is to provide a lever engagement type connector which, when the operator pressingly manipulates the engagement manipulation lever to engage the connectors, makes it possible to prevent the operator's fingertip from mistakenly touching the lock portion provided on the engagement manipulation lever, and therefore does not lead to the loss of the operational sound and the manipulation feeling generated at the time of normal locking operation of the lock portion, thereby overcoming the above-described problems of the related art. Another object of the invention is to provide a lever engagement type connector which is capable of prevent the lock portion of the engagement manipulation lever from inadvertently colliding against an external device or the like and becoming damaged during such as transport.

A lever engagement type connector according to a first aspect of the invention includes a first connector; a second connector to be engaged with the first connector; and a lever including a connection portion at which the lever is jointed to the first connector, and an end portion at which the lever is jointed to the second connector so as to rotate from a first position to a second position, an operation portion which is provided at an opposite side of the end portion respective to the connection portion, and a lock portion which is provided between the operation portion and the first connector when the lever is at the first position and is engaged with the second connector when the lever is at a second position. Preferably, the operation portion defines a touching surface and the lock portion is provided below the touching surface.

A second aspect of the invention is a lever engagement type connector according to the first aspect in which the lever has a couple of facing surfaces which is positioned below the operation portion and the lock portion is provided between the facing surfaces.

A third aspect of the invention is a lever engagement type connector according to the first or the second aspect in which the operation portion is positioned at a proximal end of the lever and the lock portion is at inner position than the operation portion.

A fourth aspect of the invention is a lever engagement type connector according to the first aspect in which the operation portion is positioned at an outside of a trajectory which is drawn by the lock portion while the lever rotates from the first to the second position.

A fifth aspect of the invention is a lever engagement type connector according to the first aspect in which the lock portion is positioned in a trajectory of the touching surface which the touching surface draws when the lever rotates between the first and the second positions.

According to the above-described first aspect, since the lock portion on the lever is disposed within the lock mechanism-use area which cannot be touched by the operator's fingertip pressing the operation portion, when the operator pressingly manipulates the operation portion of the engagement manipulation lever to engage the connectors, it is possible to prevent the operator's fingertip from touching the lock portion by mistake.

Accordingly, the loss of the operational sound and the manipulation feeling which are generated by the lock portion at the time of the normal locking operation is not caused by the erroneous contact by the operator's fingertip. Thus, the operator is able to speedily perceive the completion of the engagement operation from the operational sound and the manipulation feeling of the lock portion, thereby making it possible to improve work efficiency.

In addition, since the lock portion on the lever is accommodated in the lock mechanism-use area, it is also possible to prevent the lock portion from inadvertently colliding against an external device or the like and becoming damaged during such as transport.

According to the above-described second aspect, since the lock mechanism-use area is realized by a relatively simple structure consisting of the pair of opposing walls, it is possible to prevent the structure of the engagement manipulation lever from becoming complex.

According to the above-described third aspect, in comparison with the related lever engagement type connector in which the operation portion is disposed more on the inner side than the lock portion, it is possible to gain a greater lever ratio at the time when the engagement manipulation lever undergoes the lever motion. Hence, the manipulation force at the time of the lever motion can be made smaller.

According to the above-described fourth aspect, the operation portion is located more on the outer side in the radial direction of rotation than a locus of rotation on the line of extension of the locus of rotation of a manipulating portion of the lock portion. Therefore, there is no possibility of the manipulating portion of the lock portion becoming touched by mistake at the time of manipulating the operation portion, thereby making it possible to prevent the erroneous manipulation of the lock portion.

According to the above described fifth aspect of the invention, the lock portion is positioned in a trajectory of the touching surface which the touching surface draws when the lever rotates between the first and the second positions. Therefore, it is prevented that the user touches the lock portion when he or she operates the lever.

According to the lever engagement type connector in accordance with the invention, since the lock portion on the engagement manipulation lever is disposed within the lock mechanism-use area which cannot be touched by the operator's fingertip pressing the operation portion, when the operator pressingly manipulates the operation portion of the engagement manipulation lever to engage the connectors, it is possible to prevent the operator's fingertip from touching the lock portion by mistake.

Accordingly, the loss of the operational sound and the manipulation feeling which are generated by the lock portion at the time of the normal locking operation is not caused by the erroneous contact by the operator's fingertip. Thus, the operator is able to speedily perceive the completion of the engagement operation from the operational sound and the manipulation feeling of the lock portion, thereby making it possible to improve work efficiency.

In addition, since the lock portion on the engagement manipulation lever is accommodated in the lock mechanism-use area, it is also possible to prevent the lock portion from inadvertently colliding against an external device or the like and becoming damaged during such as transport.

DETAIL DESCRIPTION OF EXEMPLARY EMBODIMENT OF THE PRESENT INVENTION

Figure 1:
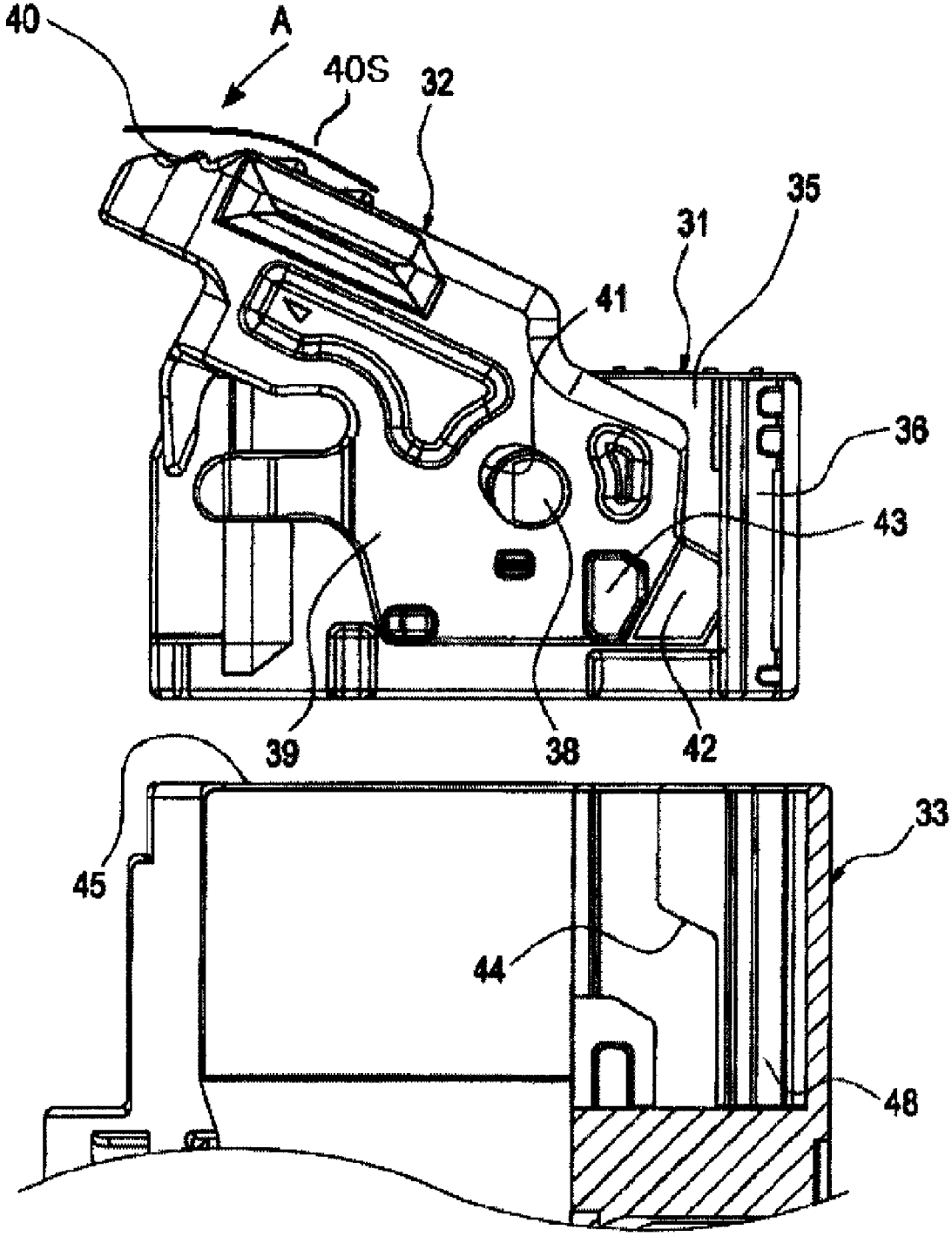
FIG. 1 is an elevational side view of an opposing state prior to engagement between a male connector and a female connector constituting an embodiment of the lever engagement type connector in accordance with the invention.
Figure 2:
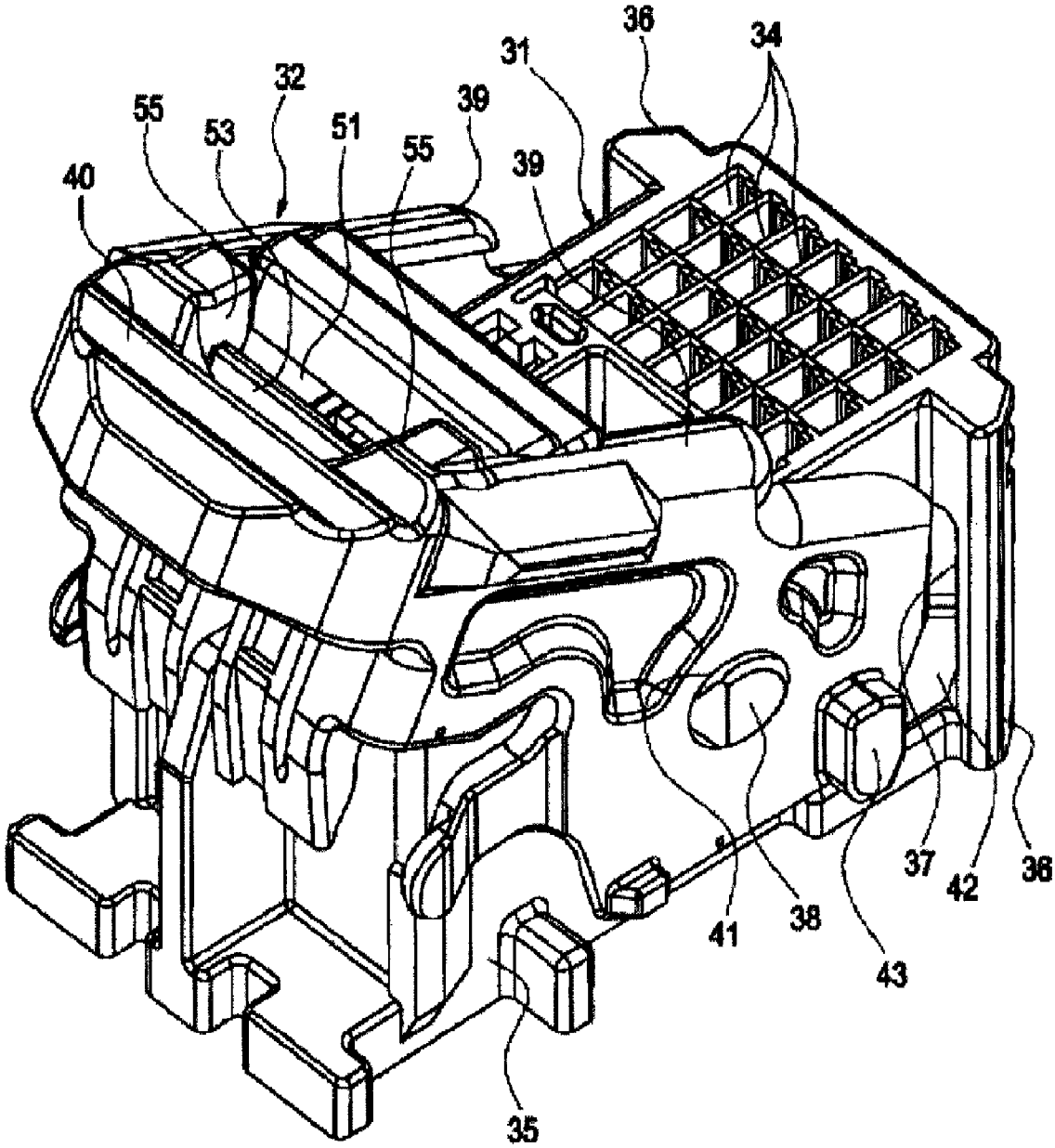
FIG. 2 is a perspective view of the male connector shown in FIG. 1.

Hereafter, referring to the accompanying drawings, a detailed description will be given of a preferred embodiment of a lever engagement type connector in accordance with the invention FIG. 1 is a side elevational view of an opposing state prior to engagement between a male connector and a female connector constituting an embodiment of the lever engagement type connector in accordance with the invention. FIG. 2 is a perspective view of the male connector shown in FIG. 1.

The lever engagement type connector in accordance with this embodiment is comprised of a male connector 31, an engagement manipulation lever 32 rotatably attached to the male connector 31, and a female connector 33 serving as a mating connector into which the male connector 31 is engaged.

In the same way as the related male connector, the male connector 31 has a plurality of terminal accommodating chambers 34 for accommodating terminals therein, and a pair of latch ribs 36 extending in the connector engaging direction (vertical direction in FIG. 1) are formed at distal end portions of side surfaces 35 on both sides so as to project therefrom.

Further, an elongated hole 37 is provided between each of these latch ribs 36 and the side surface 35 along the connector engaging direction, as shown in FIG. 2. In addition, a boss portion 38 serving as a point of application during the rotation of the engagement manipulation lever 32 is projecting provided on a substantially central portion in each of the side walls 35 of the male connector 31 in such a way as to rotatably connect the engagement manipulation lever 32.

As shown in FIGS. 1 and 2, the engagement manipulation lever 32 has a pair of right and left side walls 39 and a operation portion 40 for connecting proximal end sides of the left and right side walls 39. A connecting hole 41, into which the boss portion 38 of the male connector 31 is rotatably fitted, is formed in each of the pair of left and right side walls 39. This connecting hole 41 functions as a connecting portion for rotatably connecting the engagement manipulation lever 32 to the male connector 31.

The operation portion 40 of the engagement manipulation lever 32 serves as a point of effort during the rotation of the engagement manipulation lever 32 by being pressingly operated at the time of the operation start of engagement between the connectors, and is provided so as to connect the proximal ends of the left and right side walls 39.

The operation portion 40 has a touching surface 40S where an operator touches when he or she pressingly operates the operation portion. Although the touching surface 40S is a surface shown in FIG. 1 in this embodiment, the definition of the touching surface 40S is not limited to this embodiment. Regardless any configuration of the operation portion 40, the touching surface 40S can be defined as a surface where the operator touches when he or she pressingly operates the operation portion.

In the case of this embodiment, the operation portion 40 is disposed at an uppermost position on a most proximal side of the engagement manipulation lever 32. Further, at a position slightly inwardly lower from this operation portion 40, a lock mechanism area 51 which cannot be touched by the operator's finger pressing the operation portion 40 is secured, and a lock portion 53 is disposed within that lock mechanism area 51.

Namely, in the case of the engagement manipulation lever 32 of this embodiment, the position where the operation portion 40 is provided is located on the most proximal end side of the engagement manipulation lever 32. Additionally, the lock portion 53 is provided on the inner side (the position close to the connecting hole 41 side) of the operation portion 40.

When the mutual engagement between the pair of connectors 31 and 33 is completed by the rotative manipulation of the engagement manipulation lever 32, the lock portion 53 is retained to the female connector 33, to thereby restrict the return operation of the engagement manipulation lever 32. The engaging structure of the lock portion 53 is set such that, when the lock portion 53 is engaged with the female connector 33, predetermined operational sound and a unique manipulation feeling are generated to thereby allow the completion of the mutual engagement between the connectors to be perceived from the operational sound and the manipulation feeling.

In addition, in the case of this embodiment, the lock mechanism area 51 is a space between a pair of opposing walls 55 disposed in face-to-face relation below the operation portion 40. The pair of opposing walls 55 are disposed in face-to-face relation at a small spaced-apart distance of such a measure as to disable the insertion of the operator's fingertip, and provide the lock mechanism area 51 impossible for the fingertip to touch.

This is one of exemplary description of the lock portion 53 which is positioned between the operation portion 40 and the male connector 31. More specifically, the lock portion 53 is positioned in a trajectory of the touching surface 40S of the operation portion 40 which is drawn by the touching surface 40S when the operation portion 40 rotates in order to engage the male connector 31 with the female connector 33.

In the engagement manipulation lever 32 in accordance with this embodiment, an engaging projection 42, which is engaged with the elongated hole 37 of the latch rib 36 of the male connector 31, is provided at an end portion of each side wall 39 on the opposite side to the operation portion 40.

As the engaging projection 42 is thus engaged with the latch rib 36, the engagement manipulation lever 32 is prevented from coming off the male connector 31, thereby stabilizing the state of assembly of the engagement manipulation lever 32 to the male connector 31.

In addition to the above, an engaging portion 43 is projectingly provided on each of the side walls 39 on both sides of the engagement manipulation lever 32. This engaging portion 43 is provided on the side wall 39 so as to be located at a position closer to the boss portion 38 side than the engaging projection 42 at the distal end of the engagement manipulation lever 32.

In the same way as the related female connector, the female connector 33 has a hood portion 45 whose upper side is open and into which the male connector 31 is engaged. Further, an elongated groove 48 into which the latch rib 36 of the male connector 31 is inserted is provided on each of the side surfaces of this hood portion 13.

In addition, as shown in FIG. 1, a fulcrum retaining portion 44 is provided at a slightly set-back position within the hood portion 45. This fulcrum retaining portion 44 functions as a fulcrum of rotation during the rotation of the engagement manipulation lever 32 by rotatably retaining the engaging portion 43 of the engagement manipulation lever 32.

With the lever engagement type connector described above, the pair of connectors 31 and 33 to be engaged are positioned in an opposing state, as shown in FIG. 1. The engagement starting end (the lower end in FIG. 1) of the male connector 31 is then inserted into the hood portion 45 which is an engagement starting end of the female connector 33, and the engagement starting ends of the both connectors 31 and 33 are aligned with each other. The engaging portion 43 of the engagement manipulation lever 32 rotatably connected to the male connector 31 is thereby rotatably retained by the fulcrum retaining portion 44 of the female connector 33.

Next, if the operation portion 40 at the proximal end of the engagement manipulation lever 32 is pressed toward the female connector 33 side, as shown by arrow A in FIG. 1, the rotative manipulation of the engagement manipulation lever 32 includes a lever motion using the fulcrum retaining portions 44 of the female connector 33 as a fulcrum of rotation, using the connecting portions between the boss portions 38 of the male connector 31 and the connecting holes 41 of the engagement manipulation lever 32 as a point of application, and using the operation portion 40 as a point of effort. Thus, by merely applying a small force to the operation portion 40, the male connector 31 can be engaged with the female connector 33. (an example of a rotation from the first position to the second position)

Then, when the engagement between the pair of connectors 31 and 33 is completed, the lock portion 53 provided on the proximal end portion of the engagement manipulation lever 32 is engaged with the female connector 33, thereby restricting the return operation of that engagement manipulation lever 32.

With the lever engagement type connector in accordance with the above-described embodiment, since the lock portion 53 on the engagement manipulation lever 32 is disposed within the lock mechanism area 51 which cannot be touched by the operator's fingertip pressing the operation portion 40, when the operator pressingly manipulates the operation portion 40 of the engagement manipulation lever 32 to engage the connectors, it is possible to prevent the operator's fingertip from touching the lock portion 53 by mistake.

Accordingly, the loss of the operational sound and the manipulation feeling which are generated by the lock portion 53 at the time of the normal locking operation is not caused by the erroneous contact by the operator's fingertip. Thus, the operator is able to speedily perceive the completion of the engagement operation from the operational sound and the manipulation feeling of the lock portion 53, thereby making it possible to improve work efficiency.

In addition, since the lock portion 53 on the engagement manipulation lever 32 is accommodated in the lock mechanism area 51 and the exposure to the outside is minimized, it is also possible to prevent the lock portion 53 from inadvertently colliding against an external device or the like and becoming damaged during such as transport.

Furthermore, with the lever engagement type connector in accordance with this embodiment, since the lock mechanism area 51 for accommodating the lock portion 53 so as to prevent contact by the fingertip is realized by a relatively simple structure consisting of the pair of opposing walls, it is possible to prevent the structure of the engagement manipulation lever 32 from becoming complex.

In addition, with the engagement manipulation lever 32 in accordance with this embodiment, the operation portion 40 is provided on the most proximal end side of the lever, and the lock portion 53 is disposed at a position which is more on the inner side than this operation portion 40.

Figure 3:
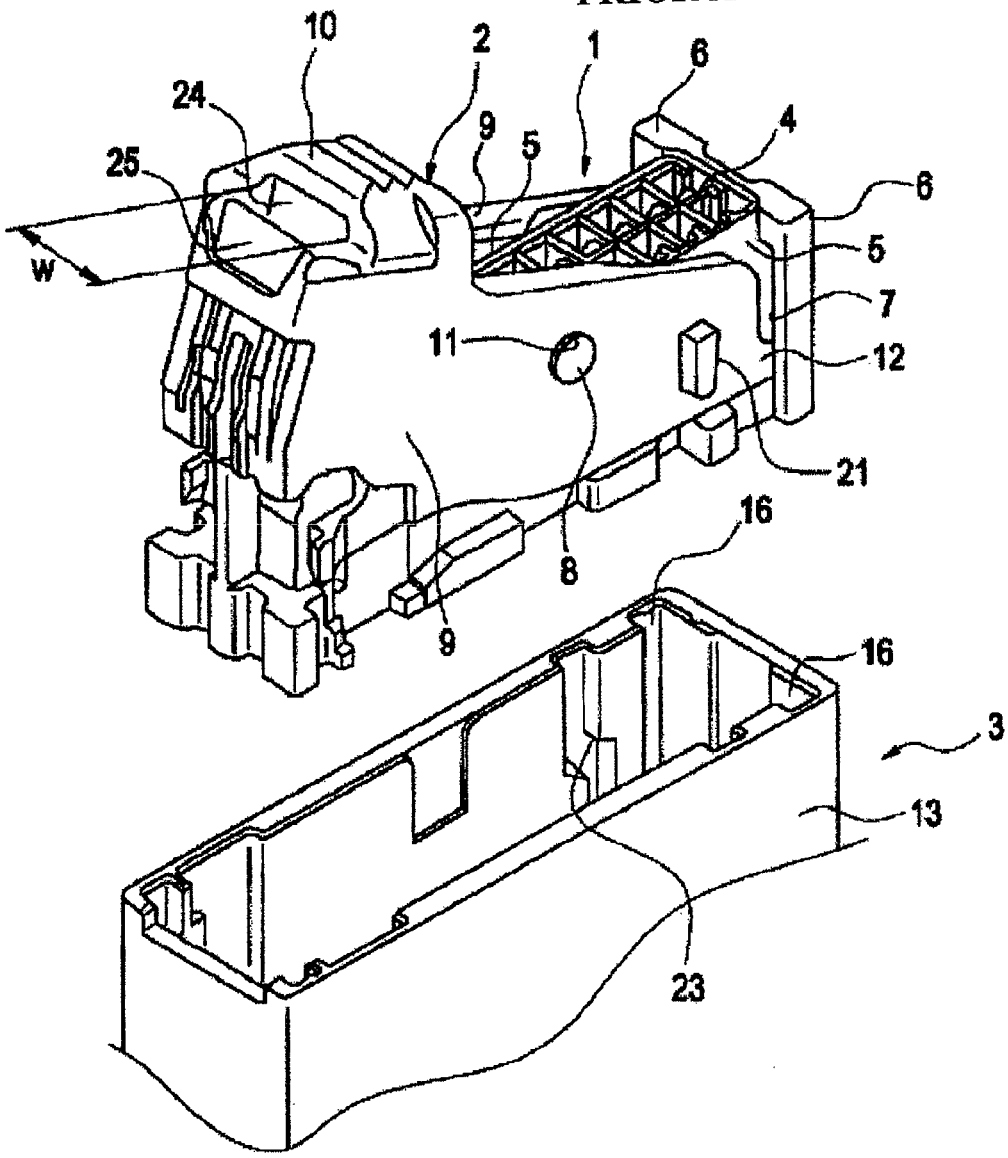
FIG.3 PRIOR ART
FIG. 3 is an exploded perspective view of a related lever engagement type connector.

Accordingly, in comparison with the related manipulation lever 2 in which the position of the operation portion 10 is disposed is disposed more on the inner side than the position of the lock portion 25, as shown in FIG. 3, it is possible to gain a greater lever ratio at the time when the engagement manipulation lever undergoes the lever motion. Hence, the manipulation force at the time of the lever motion can be made smaller.

It should be noted that the invention is not limited to the above-described embodiment. The material, the shape, the dimension, the numerical value, the form, the number, the place of disposition, and the like of the respective component elements in the above-described embodiment are arbitrary and are not limited insofar as they are such as to be able to implement the invention.

The invention claimed is:

1. A lever engagement type connector comprising:

a first connector;

a second connector to be engaged with the first connector; and a lever configured to be rotated in a rotation direction from a first position to a second position and to be engaged with the second connector when the lever is at the second position, and including:

a connection portion pivotably jointed to the first connector so that the lever is rotated in the rotation direction:

an end portion movably jointed to the second connector;

an operation portion provided at an opposite side of the end portion respective to the connection portion and having a touching surface facing a direction opposite to the rotation direction; and a lock portion, provided between the operation portion and the connection portion so as not to project from the touching surface in the direction opposite to the rotation direction, and configured to be engaged with the second connector when the lever is at the second position.

2. The lever engagement type connector according to claim 1, wherein the lever has a couple of faces facing each other and positioned forward in the rotation direction with respect to the touching surface, and the lock portion is provided between the couple of the faces.

3. The lever engagement type connector according to claim 1, wherein the operation portion is positioned at an end of the lever opposite to the end portion.

4. The lever engagement type connector according to claim 1, wherein the lock portion is positioned where the connection portion is provided with respect to a trajectory of the touching surface which the touching surface draws when the lever rotates between the first and the second positions.

5. The lever engagement type connector according to claim 1, wherein a width of the lock portion is smaller than that of the operation portion in a direction of a rotation axis of the lever.

* * * * *